United States Patent [19]

Mills

[11] Patent Number: 4,753,446

[45] Date of Patent: Jun. 28, 1988

[54] GOLF EQUIPMENT CARRIER

[76] Inventor: S. Dwight Mills, 2023 Eastview Dr., Sun City Center, Fla. 33570

[21] Appl. No.: 67,057

[22] Filed: Jun. 25, 1987

Related U.S. Application Data

[63] Continuation-in-part of Ser. No. 897,894, Aug. 19, 1986.

[51] Int. Cl.[4] ..... A63B 55/00

[52] U.S. Cl. ..... 280/47.18; 206/315.6; 211/70.2; 280/47.26; 280/DIG. 6

[58] Field of Search ..... 280/DIG. 6, DIG. 5, 280/47.18, 646, 47.26; 206/315.3, 315.4, 315.5, 316.6; 211/68, 70.2, 70.8

[56] References Cited

U.S. PATENT DOCUMENTS

| | | | |
|---|---|---|---|
| 1,418,093 | 5/1922 | Parmater | 280/DIG. 6 |
| 2,105,853 | 1/1938 | Brodie | 206/315.6 |
| 2,806,711 | 9/1957 | Jacobs | 280/DIG. 6 |
| 2,890,061 | 6/1959 | Watson | 280/DIG. 6 |
| 3,265,106 | 8/1966 | Jarman | 280/DIG. 6 |
| 3,425,708 | 2/1969 | Sato | 280/DIG. 6 |
| 3,784,138 | 1/1974 | Herling et al. | 280/DIG. 6 |
| 4,111,248 | 9/1978 | Leichardt | 211/70.2 |
| 4,181,167 | 1/1980 | Ret | 206/315.3 |
| 4,673,082 | 6/1987 | Hemme | 280/DIG. 6 |

*Primary Examiner*—David M. Mitchell

*Attorney, Agent, or Firm*—Biebel, French & Nauman

[57] ABSTRACT

A golf equipment carrier in which golf clubs are stored in an elongated generally cylindrical club receiving frame supported for rotation upon a base member. The frame comprises circular top and bottom members, with sockets for club shaft ends in the bottom member and pockets in the top member for embracing the shanks of club shafts. A labyrinthine passage provides access into the pockets from the periphery of the top member. The top and bottom members are connected by a shaft which also carries a retainer disc with a rim of resilient material positioned to engage the approximate middle of the shafts and urge them slightly outward. The frame is held on a base mounted turntable for rotation/selection of stored clubs. The carrier may be clamped to a powered golf cart which carries golfers as well as golfing equipment, to a manual cart, or be configured as a manual golf cart by means of a detachable handle and detachable wheels.

14 Claims, 5 Drawing Sheets

GOLF EQUIPMENT CARRIERcl

CROSS-REFERENCE TO RELATED APPLICATION

This application is a continuation-in-part of U.S. application Ser. No. 897,894 filed Aug. 19, 1986.

BACKGROUND OF THE INVENTION

The present invention relates generally to the game of golf, and more particularly, to a carrier for supporting golf clubs, balls, tees and other associated golfing equipment for convenient access and transport as a golfer travels around a golf course, usually although not necessarily on a motorized cart.

Golf clubs and associated golfing equipment are typically carried in a golf bag which may be slung over a golfer's shoulder and carried about a course during a round of golf. Since a full set of golf clubs, auxiliary equipment, and bag are quite heavy, alternatives to carrying the bag personally are sought after. Hiring a caddy is one alternative, but this is expensive and typically caddies are not available for everyone. More commonly, golf carts are used, and these may be the powered rider type, or a small manual cart pulled by the golfer.

Manual golf carts may add considerable additional weight to the golf bag. Also, although such carts have provisions for accepting and holding a golf bag, these tend to be rudimentary for the sake of accomodating many different styles of bags. Thus, the golf bag is usually simply strapped into a space provided by the framework of the manual pull-type golf cart, and with the limited size of the storage space available in popular smaller sized automobiles the bag may have to be removed for transportation to and from the golf course. Powered golf carts are usually designed such that golf bags simply rest on a platform at the rear of the cart, and strapped onto powered carts. In either case, a bag contains the various clubs and other equipment in a conventional way, the clubs are accessible from the top only, and the clubs are at best sorted or separated only in loose fashion.

In addition to transportation problems, conventional golf bags may also result in damage to the golf clubs. The gripping handles of golf clubs, which are typically wrapped with leather or other well known grip material, can be damaged if they are jammed downwardly into a conventional golf bag. Access to the clubs can also be a problem when conventional golf bags are used on a powered golf cart since they must clear the top of the bag which is elevated sometimes a substantial distance off the ground when fixed to the bag supporting portion of the powered cart. If a cover or umbrella is needed over a hand cart, or there is a surrey top on a motorized cart as is often the case, there is a problem withdrawing and inserting the clubs from and into the bag, in addition to the height and reach problem.

On the other hand, a less encompassing holder for clubs and related equipment must be able to withstand the bouncing and jostling which can occur as a hand cart is pulled, or a motorized cart is driven, about a golf course, often onto portions other than the fairway. Any substitute or improvement for the traditional bag must still hold the clubs (in particular) securely to prevent their dislodgment and possible loss.

It is thus apparent that an improved carrier for golf clubs and associated equipment, which provides improved access to the golf clubs, particularly when the carrier is supported upon a powered golf cart, would be appreciated by golfers who are faced with the alternative of cumbersome and heavy conventional golf bags. Such an improved golf equipment carrier is particularly desirable when it offers the potential for less weight, lower cost and serves to expand the options available to golfers who are looking for more convenient ways of pursuing their golf game.

SUMMARY OF THE INVENTION

It is a primary object of the present invention to provide an improved golf equipment carrier wherein golf clubs are supported upon an elongated rotatable frame which is supported for rotation upon a base member, from which one or more chosen clubs can readily be removed or inserted, over which a lightweight club protecting cover can easily be fitted when needed, and which holds each club securely in the frame yet allows one or more clubs to be inserted into and withdrawn from the club receiving frame in a lateral direction, without having to raise the club appreciably.

According to the preferred embodiment of the present invention, an improved golf equipment carrier comprises a bottom member having a plurality of upwardly directed socket means distributed thereabout on a circle (or concentric circles) of given diameter for receiving the ends of inverted club shafts. A top member has a corresponding plurality of club engaging means arranged in one or more circles of diameter corresponding diameter(s) to the aforementioned socket means for receiving and retaining shank portions of the club shafts. The bottom and top members are centrally interconnected by connecting means, preferably a central shaft, which serves to space the top and bottom members from one another and to form the top and bottom members into a vertically elongated club receiving frame. A shaft retaining means (preferably adjustable) is carried on the connecting means, intermediate the top member and the bottom member and of a diameter sufficient that it firmly engages the inserted, inverted club shafts about midway their length.

The top member preferably comprises a generally circular part having club engaging means in the form of slots extending radially thereinto, each slot terminating in circumferentially extending club receiving pockets which are connected to a corresponding slot through a narrowed passage or notch for passing the club shanks. Thus, the handle end of the club shaft can be inserted into one of the socket means, the shank portion of the shaft then inserted into a corresponding slot, and moved through the notch into the corresponding club receiving pocket. A safety retainer extends across the entrance to the slot, for keeping the club from falling out if the shank for some reason does not stay in the pocket. Base means are provided for supporting the club receiving frame for rotation about a generally vertical axis and preferably a vertical guiding and supporting structure extends upward from the base and includes a bearing guide at its upper end coperating with the top member to stabilize it, and also to keep it free from surrounding structure so as not to inhibit the rotation of the club holding frame.

In one embodiment, the frame is kept essentially open, and access to the clubs is available throughout approximately 240° of the frame circumference. In that embodiment, a simple pull-over lightweight waterproof cover can be fitted around the filled frame to protect the clubs. An alternative embodiment incorporates a cover member with the vertical suporting member, and has a rather narrow vertical slot, of a width corresponding to at least one club receiving socket/slot combination on the frame, through which the clubs can be inserted or removed.

While the various clubs are positioned around the frame, the frame can be easily rotated into a position such that any club can be conveniently and easily removed or inserted laterally, without appreciably lifting the club in a vertical direction. Yet, once a club is fully inserted in the frame, the club is positively retained, separated from other clubs, and will remain in place even though the frame may be bounced around, tilted through a considerable angle from vertical, or rested on its side. This is due to the slight lateral force exerted upon the approximate middle of the club shaft.

The golf equipment carrier of the present invention is particularly applicable for use on a powered golf cart yet may be readily converted to a manual golf cart. To this end, the golf equipment carrier of the present invention further comprises clamp means for securing the carrier to a powered golf cart and also a detachable handle and wheels may be provided for converting the golf equipment carrier to a manual golf cart which may be pulled by the golfer. The frame member portion of the carrier is also useful as a device for displaying clubs for sale.

The primary object of the present invention, therefore, is to provide a golf equipment carrier which has a club supporting rotatble frame with sockets in a lower member for receiving the handle end of inverted clubs, pockets in an upper member vertically aligned with the sockets and having a labyrinth-type of entry through which the shank of a club can be maneuvered, a central connecting shaft holding the upper and lower members in spaced relation along an axis of rotation, and a retainer member on the shaft, approximately mid-way between the upper and lower members and designed to exert slight outward pressure against the shaft of a fully inserted club to retain it firmly in the frame; to provide such a carrier with a base member which holds the frame in a normally vertical position and rotatable about the axis of the central shaft; to provide such a carrier with means to clamp it securely to a golf cart, or alternatively to convert it into a form of hand pull-type cart; and to incorporate appropriate receivers, pockets, or the like for storage of tees, balls, a lighweight cover, or other auxiliary equipment as the golfer may choose to carry.

Other objects and advantages of the invention will be apparent from the following description, the accompanying drawings and the appended claims.

DETAILED DESCRIPTION OF THE INVENTION

Figure 1:
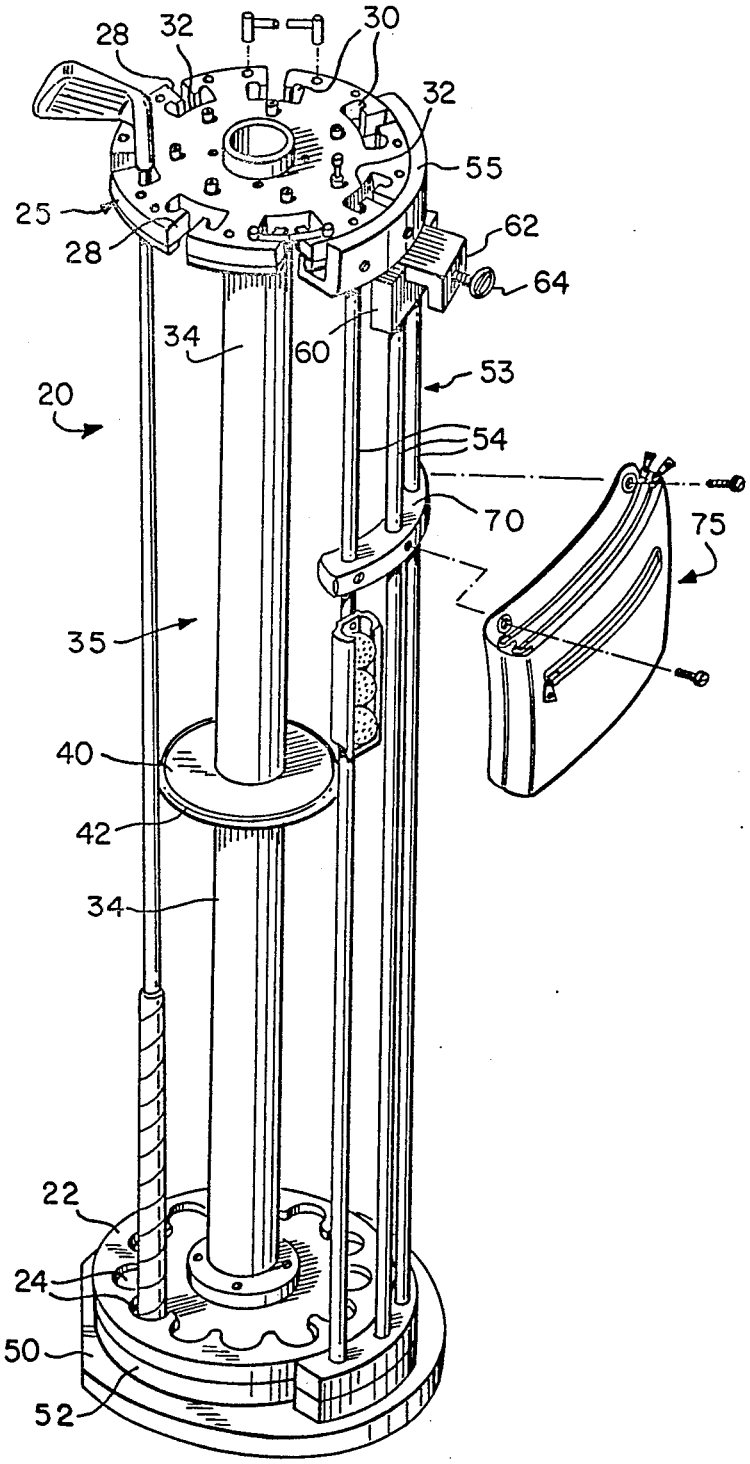
FIG. 1 is a perspective view of a golf equipment carrier in accordance with the present invention, as seen from one side of the carrier.
Figure 2:
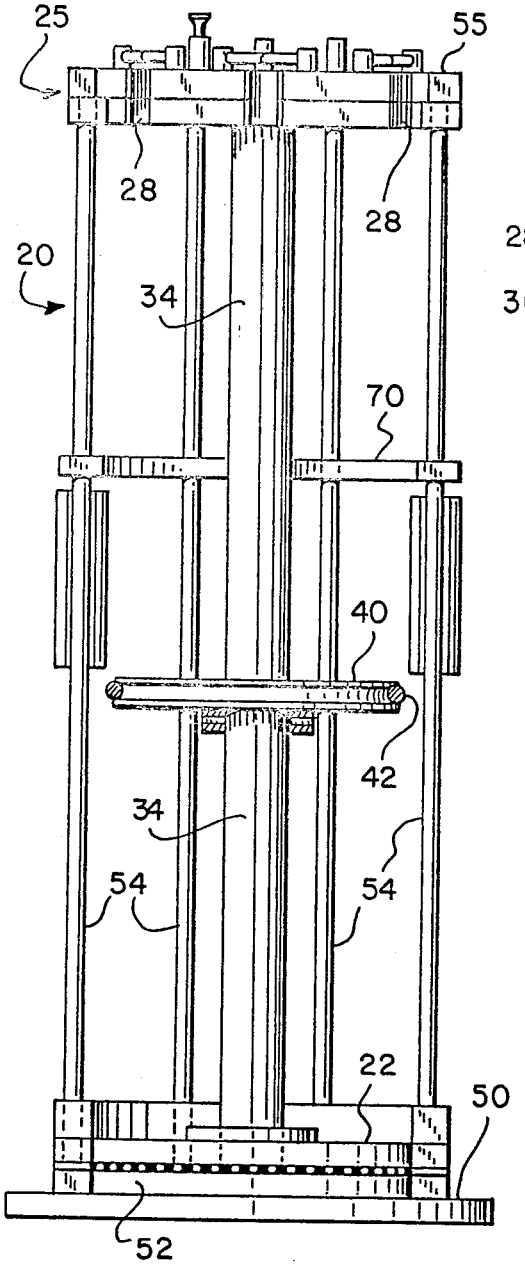
FIG. 2 is a front view of the carrier.
Figure 3:
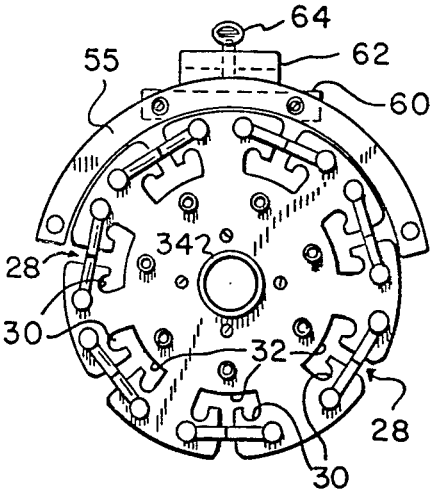
FIG. 3 is perspective view of the top part of the carrier.

FIG. 1 is a perspective view of a golf equipment carrier in accordance with the present invention. The golf equipment carrier 20 comprises a circular bottom member 22, as best shown in FIGS. 1, 2 and 3 having a plurality of upwardly directed semi-circular sockets. Preferably there are fourteen such sockets evenly distributed around a circle about the bottom member 22, since rules permit use of a set of fourteen clubs. It is noted, however, that any suitable number of sockets or equivalent could be utilized in the present invention and that a different distribution of the sockets is possible, for example locating adjacent sockets on concentric circles of different diameter. However, the outwardly facing part of the club end must be embraced to inhibit any radially outward movement once a club is in place.

A circular top member 25 has formed in it a plurality of generally radially extending slots 28 (FIG. 3), each of the slots providing an opening into a pair of opposed club shank receiving pockets 30 which are located generally circumferentially outward in opposite directions from the corresponding slot 28 and are connected thereto by a narrow passage or notch 32. This provides a form of labyrinth between the slot opening at the periphery of member 25, and the respective pockets 30. Safety catches in the form of stiff, but flexible pins 37 of rubber or suitable plastic are mounted extending across the open ends of slots 28 to prevent accidental disengagement of a club shank from the slot, should it be dislodged in some way from its corresponding pocket. A tubular member or shaft 34 centrally interconnects the top member 25 and the bottom member 22, spaced apart vertically by a distance which is less by about two inches than the length of the shortest club shaft, so as to accomodate sets of clubs having different lengths. Thus, the top and bottom members 22 and 25 together with the shaft 34 form a vertically elongated club receiving frame designated by the general reference numeral 35.

Figure 4:
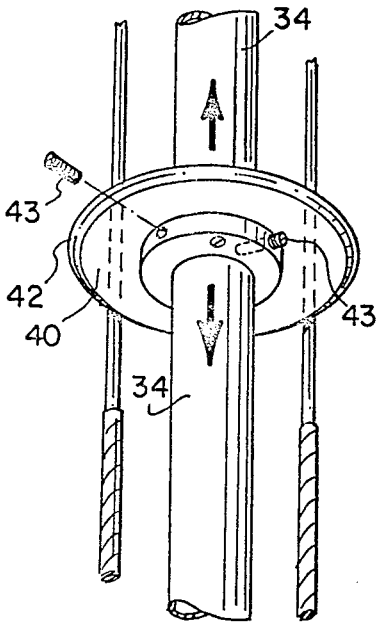
FIG. 4 is a detail view of the central retainer member for engaging the club shafts.

The vertically elongated club receiving frame 35 includes club shaft retaining or spreading means comprising a disc 40 (FIG. 4) having an outer annular layer 42 made of rubber or other relatively soft resilient material. The disc 40 is adjustably fastened to shaft 34 by one or more set screws 43, or the like, at a location intermediate the bottom member 22 and top member 25, such that outer layer 42 positively engages all club shafts supported on frame 35.

A club is inserted into the frame by inverting it, handle downward, and placing the end of the handle in one of sockets 24. Then, the shank portion of the club shaft is moved into a vertically corresponding one of the slots 28, moved through the narrow passage 32 into the corresponding vertically aligned pocket 30. In so doing, the club shaft is forced against the layer 42 on disc 40. The force exerted by the compressed outer layer 42 the club retaining means is sufficient to hold the club firmly in the frame 35 and substantially prevent movement of the club. The retaining disc 40 can be adjusted along shaft 34, to accommodate the carrier to storage of different length clubs. In general, the outer layer 42 should contact the club shaft about two inches above the end of the handle or grip.

Figure 5:
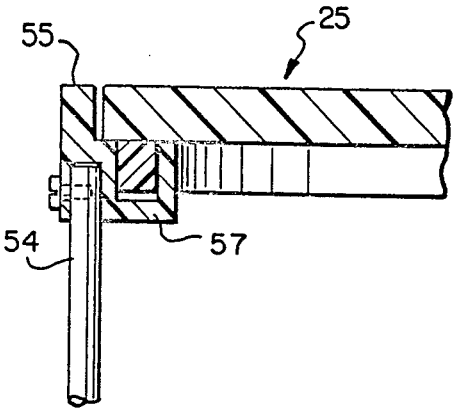
FIG. 5 is a detail view showing the relation of the vertical support member to the upper part of the carrier.
Figure 6:
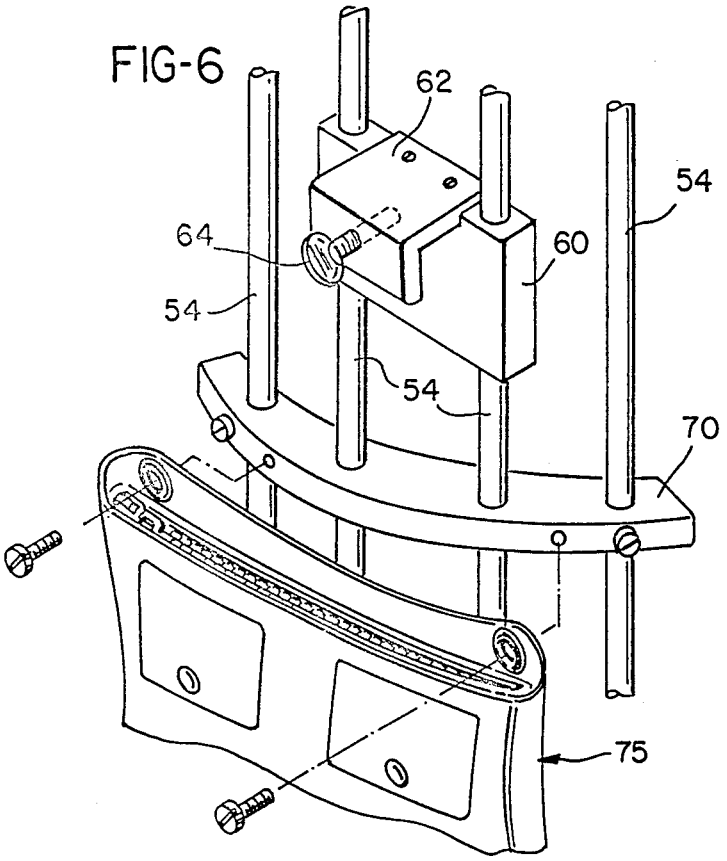
FIG. 6 is a detail perspective view showing the adjustable mounting for the auxiliary equipment pouch, and the clamp for attaching the carrier to a cart.

The frame is rotatably supported on a base means comprising a base plate 50 of somewhat larger lateral dimensions than the cross-sectional area of the frame 35, and including a turntable 52 secured to the frame and the base plate, respęctively. Extending upward from the base plate 50 is a vertical support structure 53 made up of a plurality of parallel rods 54 (FIGS. 1 and 6) and an arcuate upper stabilizing bracket 55 which includes a lip 57 interacting with the bottom of upper member 25 (see FIG. 5). This structure tends to keep the upper end of the frame "on axis" when rotated, even if loading on it may be variable or imposed high up the frame, as by a person grasping at or just below the upper member and imparting a turning force at that point.

An attachment or clamping means for the carrier is provided in the form of an adjustable slide 60 mounted on two of the rods 54 which are closest to the center of support structure 53. Extending from this slide is an inverted L-shaped clamp bar 62, including a thumbscrew type clamp member 64. This attachment means adapts readily to variable height and/or thickness or shape of structure to which the carrier may be secured. Typically, such structure might be a cross bar on a motorized golf cart, or a bracket on a hand cart. The base member is placed on a platform or stand (usually a part of a cart). Then the slide is moved so the bar 62 encompases such a cross bar or bracket, and the member 64 is tightened accordingly. This holds the base member against the platform and also holds the upper part of the carrier securelt to the cart, all with a simple and rapid action.

Below the attachment means, at the expected lower limit of movement of slide 60, is a wider bracket plate 70 which is secured to the rods 54, and which provides a mounting for a multi-pocket receiver 75 for extra balls, tees, a cleaning cloth, a lightweight waterproof pullover cover for the carrier and clubs therein, and other equipment ot paraphenalia an individual golfer might wish to have available. An umbrella can be stored in the central tube or shaft 34 if its upper end is left open above upper frame member 25.

Figure 7:
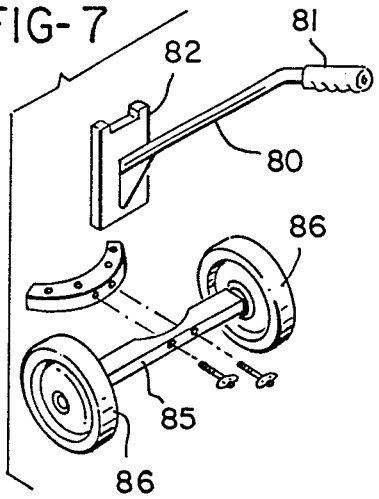
FIG. 7 shows the attachment of wheels and a handle to the carrier to convert it to a manual golf cart.

It is possible to provide a push-pull type handle and a wheel/axle set as accessories which can be attached to the carrier to convert it into a manual cart arrangement. FIG. 7 shows a handle arm 80 with a grip 81 at its one end, and an adapter block 82 at its other end which is constructed to fit within and be clamped to the clamb bar 64. Also shown is an axle member 85 with attached wheels 86 at its opposite ends. The center part of axle member 85 is shaped to fit against a vertically adjustable arcuate bracket plate 87 which is fitted onto the rods 54, clamped thereto by set screws (not shown). The axle member can readily be attached to plate 87 with a pair of bolt/wing fasteners 88. Vertical adjustment of bracket plate 87 provides for accomodation of different sizes of wheels, as may be desirable.

Figure 8:
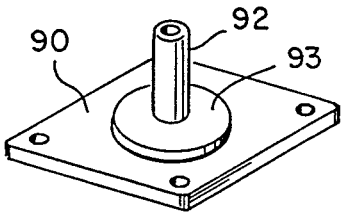
FIG. 8 illustrates a modified form of base means for the carrier.

FIG. 8 shows another form of base plate 90 which may be made a more permanent part of a motorized cart, in particular, and which has a support tube 92 which can telescope upward within the central shaft 34. A turntable 93 on the base plate, surrounding tube 92, can be secured to the bottom member 22 of the carrier frame 35, thus making the carrier a more permanent accessory to the cart.

FIGS. 9–12 show a modified form of carrier, in which different devices are used to retain the shanks of the clubs in the upper member, and in which a cover is an integrated part of the carrier, leaving a vertically elongated slot-like opening for the insertion and withdrawal of a selected club. In this embodiment, the base member or plate 128 supports a frame which includes a lower member 108 with sockets 110 for receiving the ends of club shafts. Lower member 108 and the upper member 112 are connected by a central shaft 124, and upper member 112 is provided with a plurality of resilient clips 114 which can snap around the shank end of a shaft. Cover means comprising a cover sleeve 138 extends between and is secured to the base plate 128 and a partial upper ring 140 for protecting clubs supported upon the club receiving frame 126. Sleeve 138 wraps around the upright bars 142 which connect base plate 128 and ring 140, and includes an opening 139 which extends from the top of the cover 138 at least a substantial distance toward the bottom member 108, preferably all the way to the bottom of the cover 138. Accordingly, the cover is semicylindrical and the platform 140 which is recessed within an upper end of the cover sleeve 138 and coextensive therewith is semiannular.

Figure 9:
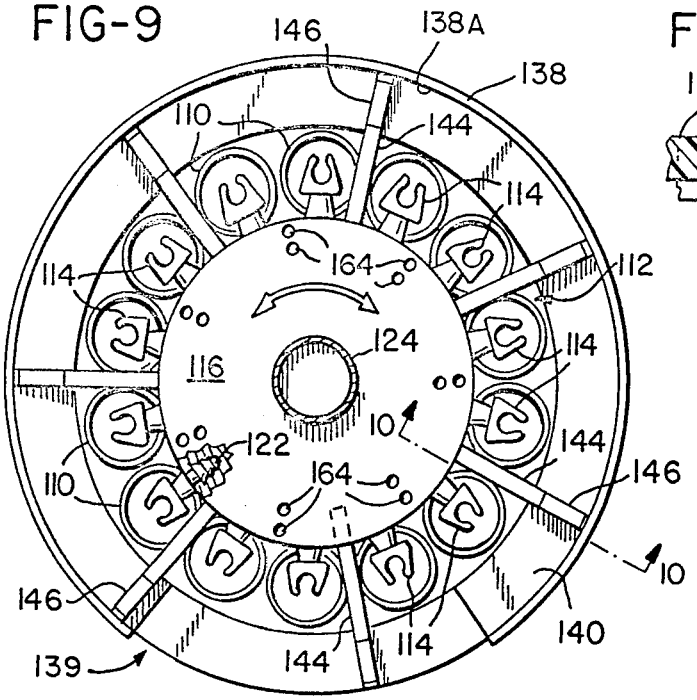
FIG. 9 is a top view of a modified form of carrier, showing the top member and the upper end of an integral cover used in this embodiment.
Figure 10:
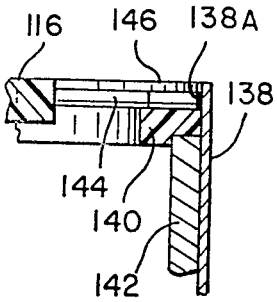
FIG. 10 is a sectional view taken along the section line 10—10 of FIG. 9.
Figure 11:
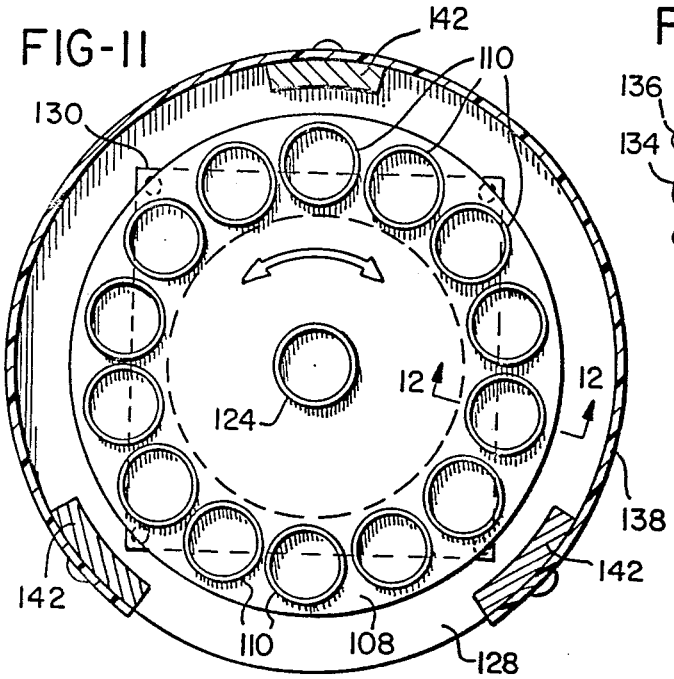
FIG. 11 is a cross-sectional view showing the bottom part of the modified form of carrier.
Figure 12:
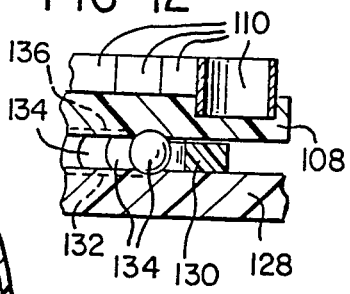
FIG. 12 is a partial sectional view taken along line 12—12 of FIG. 11.

As best shown in FIGS. 8 and 9, the sleeve 138 and platform 140 form the base of positioning means for supporting and centering the top or upper member 112 of the elongated club receiving frame 126. The positioning means also comprises a plurality of radial extensions 144 from a circular central member 116. The axial extensions 144 are sized such that they slide within an inner surface 138A of cover 138 and bear upon platform 140. Extensions 144 may comprise aluminum rods having their distal ends covered by tubular members 146 (formed of nylon or the like) for reduced friction bearing with cover 138 and platform 140. The tubular shaft member 124 preferably extends above the top member 112 and presents an open end for receiving a ball retriever, an umbrella or other elongated piece of golf equipment.

Figure 14:
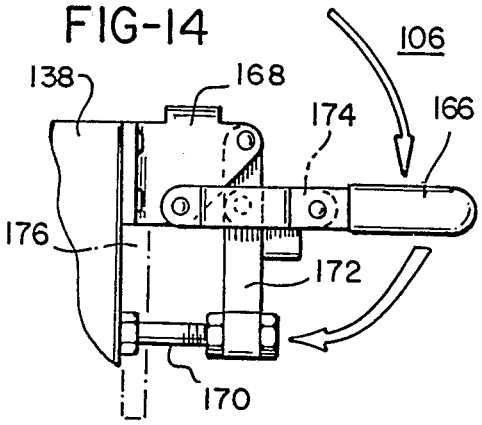
FIGS. 13 and 14 show a an alternate form of clamp for removably securing the carrier to a golf cart.
Figure 13:
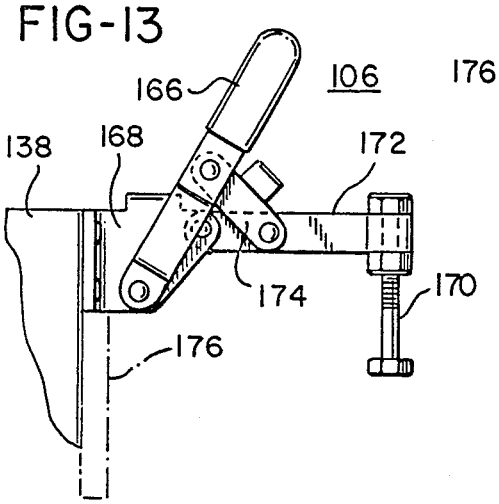

The clamp means 106 shown in FIGS. 13 and 14 can be employed as a substitute for the clamp bar 62 and screw 64. The clamp means 106 comprises a main clamp frame 168 which may be secured to the slide 60, and a clamp handle 166 is pivotally mounted to the clamp main frame 168. An adjustable clamping rod 170 is secured to an arm 172 which is also pivotally mounted to the clamp main frame 168. The clamping member 170 is moved from an open position shown in FIG. 13 to a closed position shown in FIG. 14 as the handle 166 is snapped into a locked position defined by a link 174 which pivotally interconnects the handle 166 and the arm 172. The member 176 represents a cross bar on a powered golf cart, as previously mentioned.

As in the preferred embodiment, the vertically elongated club receiving frame can be rotated to position any club adjacent opening 139 in cover 138. Rotation of the frame can be conveniently effected by grasping the tubular member shaft 124 or one of extensions 144.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A golf equipment carrier for securely holding a plurality of golf clubs, comprising:

a circular bottom member having a plurality of socket means distributed thereabout for receiving the ends of inverted club shafts and for retaining such ends against movement outward of said bottom member;

a circular top member having a corresponding plurality of club engaging means for receiving shank portions of the club shafts and for retaining said shank portions against movement outward of said top member;

connecting means for centrally interconnecting said top and bottom members with the respective said retaining means generally vertically aligned and for spacing said top and bottom members from one another to form an elongated club receiving frame in which the club shafts are located inverted and spaced apart around a circular path;

shaft spreading means secured to said connecting means intermediate said top member and said bottom member and extending into the circular path for engaging club shafts inserted into said club receiving frame and for exerting an outwardly directed force against such shafts when the clubs are engaged with said socket means and said club engaging means to positively retain the clubs in said frame, and base means for supporting said club receiving frame for rotation about a generally vertical axis.

2. A golf equipment carrier as claimed in claim 1 wherein said connecting means comprises a tubular shaft member open above said top member for receiving an elongated piece of golf equipment.

3. A golf equipment carrier as defined in claim 1, said bottom member having said socket means arranged in at least one socket circle corresponding to said circular path, of predetermined radius around said connecting means to receive the shaft ends of inverted clubs, said top member having a corresponding plurality of pockets defining said engaging means and arranged in a corresponding circle of approximately the same radius for receiving the shank portions of the clubs, said shaft spreading means comprising a disc member mounted on said connecting means and having a resilient rim of a radius slightly greater than the radius of the socket circle and pocket circle so as to exert an outward force against a central part of the club shaft for holding the end and shank of the shaft in the corresponding socket and pocket.

4. A golf equipment carrier as defined in claim 3, said top member having slots extending inward from its edge and connected to one side of said pockets to form passages for inserting and removing the shank end of a club shaft with respect to the related pocket.

5. A golf equipment carrier as claimed in claim 1 further comprising positioning means for supporting and centering said top member, said positioning means comprising a vertical support structure extending upward from said base means to said top member, and a stabilizing bracket on said vertical support structure interacting with a portion of the periphery of said top member to confine lateral motion of said top member.

6. A golf equipment carrier as claimed in claim 5 wherein said positioning means comprises an arcuate platform fixed to the upper end of said support structure and being coextensive therewith, said platform partially surrounding said top member of said frame, a plurality of radial extensions projecting from said top member over and bearing upon said platform in sliding engagement therewith, and cover means attached to and surrounding said support structure extending from said base means to said platform and around said frame, said cover means having a vertically extending slot-like opening therein adapted for alignment with one of the clubs supported in said frame.

7. A golf equipment carrier as claimed in claim 1 further comprising means for securing said golf equipment carrier to a cart.

8. A golf equipment carrier as claimed in claim 1 further comprising a detachable handle and wheels for converting said golf equipment carrier to a manual golf cart which may be pulled by a golfer.

9. A golf equipment carrier as claimed in claim 1 wherein said club engaging means comprises a plurality of slots extending radially inward from the edge of said top member, each of said slots terminating in a club receiving pocket extending to one side of its corresponding slot and connected thereto by a shaft retaining notch whereby the end of a club shaft can be inserted into one of said socket means, the shank portion of the shaft then being inserted into a corresponding one of said slots while engaging a central part of the club shaft with said shaft spreading means as the shank portion is moved through said notch and into the corresponding said pocket.

10. A golf equipment carrier for securely holding a plurality of golf clubs, comprising:

a circular bottom member having a plurality of upwardly facing sockets arranged in at least one socket circle of predetermined radius concentric with said bottom member to receive the handle ends of inverted clubs;

a circular top member having a plurality of pockets corresponding in number to said sockets and arranged inwardly of the periphery of said top member in a pocket circle of approximately the same radius as said socket circle for receiving the shank portions of the clubs, said top member also having slots extending inward from its periphery to adjacent one side of said pockets and a corresponding plurality of narrow passages connecting said slots to said pockets to form passages for inserting and removing the shank end of a club shaft with respect to the related pockets;

a tubular shaft centrally interconnecting said top and bottom members and spacing said top and bottom members from one another to form an elongated club receiving frame;

shaft retaining means comprising a disc member mounted on said shaft and having a resilient rim of a radius slightly greater than the radius of at least one of the socket circle and pocket circle so as to exert an outward force against a central part of the club shaft, thereby holding the end and shank of the shaft in the corresponding socket and pocket and positively retaining the club in said frame, and a base including a turntable supporting said club receiving frame in a vertical position and for rotation about the axis of said shaft.

11. A golf equipment carrier as defined in claim 10, further including retainer catch means extending across said slots to prevent accidental movement of a club shank out of a slot.

12. A golf equipment carrier as claimed in claim 10 further comprising positioning means for supporting and centering said top member, said positioning means comprising a vertical support structure extending upward from said base means to said top member, and a stabilizing bracket on said vertical support structure interacting with a portion of the periphery of said top member to confine lateral motion of said top member.

13. A golf equipment carrier as defined in claim 12, further comprising a clamp device adjustably connected to said support structure and adapted for attachment to a retainer piece on a cart.

14. In a golf equipment carrier for securely holding a plurality of golf clubs, a club-holding frame comprising:

a bottom member having a plurality of upwardly facing sockets arranged in at least one socket circle of predetermined radius to receive the handle ends of inverted clubs;

a top member having a plurality of pockets corresponding in number to said sockets and arranged inwardly of the periphery of said top member in a pocket circle of approximately the same radius as said socket circle for receiving the shank portions of the clubs, said top member also having slots extending inward from its periphery to adjacent one side of said pockets and a corresponding plurality of narrow passages connecting said slots to said pockets to form passages for inserting and removing the shank end of a club shaft with respect to the related pockets;

a shaft centrally interconnecting said top and bottom members on the axis of said circles and spacing said top and bottom members from one another to form an elongated club receiving frame; and shaft retaining means comprising a disc member mounted on said shaft and having a resilient rim of a radius slightly greater than the radius of at least one of the socket circle and pocket circle so as to exert an outward force against a central part of the club shaft, thereby holding the end and shank of the shaft in the corresponding socket and pocket and positively retaining the club in said frame.

* * * * *